US006279283B1

(12) United States Patent
Hohmann et al.

(10) Patent No.: US 6,279,283 B1
(45) Date of Patent: Aug. 28, 2001

(54) LOW-PROFILE WALL TIE

(75) Inventors: Ronald P. Hohmann; Ronald P. Hohmann, Jr., both of Syosset, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 0 days.

(21) Appl. No.: 09/547,637

(22) Filed: Apr. 12, 2000

(51) Int. Cl.[7] ..... E04B 1/16

(52) U.S. Cl. ..... 52/379; 52/378; 52/729.3; 52/712

(58) Field of Search ..... 52/729.3, 712, 52/379, 443, 449, 453, 713, 562, 383, 378

(56) References Cited

U.S. PATENT DOCUMENTS

| | | | | |
|---|---|---|---|---|
| 2,605,867 | * | 8/1952 | Goodwin | 52/379 |
| 5,392,581 | * | 2/1995 | Hatzinikolas | 52/712 |
| 5,408,798 | * | 4/1995 | Hohmann | 52/562 |
| 5,456,052 | * | 10/1995 | Anderson et al. | 52/379 |
| 6,209,281 | * | 4/2001 | Rice | 52/379 |

* cited by examiner

*Primary Examiner*—Carl D. Friedman
*Assistant Examiner*—Chi Nguyen
(74) *Attorney, Agent, or Firm*—Siegmar Silber

(57) ABSTRACT

A veneer anchoring system discloses a low-profile wall tie for use in a wall having an inner wythe and an outer facing wythe. The wythes are in a spaced apart relationship and form a cavity therebetween. A combination of a wall anchor and a low-profile wall tie member is provided. The veneer anchoring systems hereof incorporate low-profile wall ties adapted for use with a dry-wall inner wythe and for use with a masonry block inner wythe. The masonry anchor has a truss portion with eye wire extensions welded thereto. The eye wires extend into the cavity between the wythes. Each eye wires accommodates the threading thereonto of a wire wall tie through the open end of the wall tie. The wall tie is then positioned so that the open end is utilizable as part of the facing wall tie. The masonry anchor is embedded in a bed joint of the interior wythe. The facing wythe is anchored by mounting in bed joints of the exterior wythe the open end of the low-profile wire formative wall tie. The low-profile permits the mortar of the bed joint to flow over and about the insertion end of the wall tie and secure the tie to the outer wythe. Where the inner wythe is a dry wall construct, a dry wall anchor, which is a stamped metal unit, is attached by sheetmetal screws to the metal vertical channel members of the wall.

22 Claims, 6 Drawing Sheets

LOW-PROFILE WALL TIE

BACKGROUND OF THE INVENTION

1. Field of the Invention

This invention relates to an improved wall tie for a veneer anchoring system for use in conjunction with a wall structure having an inner wythe and an outer wythe, and, more particularly, to construction techniques for embedding low profile wire formatives in the bed joints of the inner and outer wythes having an interlocking arrangement between the wall tie and an inner wythe anchor. One aspect of the invention is to provide the anchoring of an outer wythe of brick or masonry veneer to an inner wythe of masonry block or drywall construction.

2. Description of the Prior Act

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy-wire anchors, with greater diameters, frequently result in misalignment and look towards substituting thinner gage wire formatives. Such substitution thereby facilitating alignment of courses.

In the past, there have been investigations relating to the effects of various forces, particularly lateral forces, upon brick veneer construction having wire formative anchors embedded in the mortar joint of anchored veneer walls. The seismic aspect of these investigations were referenced in the first-named inventor's prior patent, namely U.S. Pat. Nos. 4,875,319 and 5,408,798. Besides earthquake protection, the failure of several high-rise buildings to withstand wind and other lateral forces has resulted in the incorporation of a requirement for continuous wire reinforcement in the Uniform Building Code provisions. The first-named inventor's related Seismiclip$^R$ and DW-10-X$^R$ products (manufactured by Hohmann & Barnard, Inc., Hauppauge, N.Y. 11788) have become widely accepted in the industry. The use of a wire formative anchors in masonry veneer walls has also demonstrated protectiveness against problems arising from thermal expansion and contraction and has improved the uniformity of the distribution of lateral forces in a structure. However, these investigations do not address the mortar layer thickness vs. the wire diameter of the wire formative or technical problems arising therefrom.

The following patents are believed to be relevant and are disclosed as being known to the inventor hereof:

| Patent | Inventor | Issue Date |
|---|---|---|
| 3,377,764 | Storch | 04/16/1968 |
| 4,021,990 | Schwalberg | 05/10/1977 |
| 4,373,314 | Allan | 02/15/1983 |
| 4,473,984 | Lopez | 10/02/1984 |
| 4,869,038 | Catani | 09/26/1989 |
| 4,875,319 | Hohmann | 10/24/1989 |

It is noted that these devices are generally descriptive of wire-to-wire anchors and wall ties and have various cooperative functional relationships with straight wire runs embedded in the interior and/or exterior wythe. Several of the prior art items are of the pintle and eyelet/loop variety.

U.S. Pat. No. 3,377,764—D. Storch—Issued Apr. 16, 1968

Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977

Discloses a dry wall construction system for anchoring a facing veneer to wallboard/metal stud construction with a pronged sheet-metal anchor. Like Storch '764, the wall tie is embedded in the exterior wythe and is not attached to a straight wire run.

U.S. Pat. No. 4,373,314—J. A. Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4.473.984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued Sep. 26, 1989

Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989

Discloses a seismic construction system for anchoring a facing veneer to wallboard/metal stud construction with a pronged sheet-metal anchor. Wall tie is distinguished over that of Schwalberg '990 and is clipped onto a straight wire run.

None of the above provide the masonry construction system for an inner masonry wythe and an outer facing wythe with low-profile wire formative wall ties as described hereinbelow.

SUMMARY

In general terms, the invention disclosed hereby includes a veneer anchoring system incorporating a low-profile wall tie for use in the construction of a wall having an inner wythe and an outer facing wythe. The wythes are in a spaced apart relationship and form a cavity therebetween. In the first two embodiements disclosed, a unique combination of a wall anchor and a low-profile wall tie member is provided. The invention contemplates that the primary components of the system are reinforcing wire and wire formatives, such as truss reinforcement or ladder mesh reinforcements, providing wire-to-wire connections therebetween.

In third embodiment, the invention disclosed hereby includes a veneer anchoring system incorporating a low-profile wall tie for use in the construction of a wall having an inner dry-wall wythe and an outer facing wythe. The wythes are in a spaced apart relationship and form a cavity therebetween. In this embodiment, a unique combination of a wall anchor and, a low-profile wall tie member is provided. The invention contemplates that the primary components of the system are veneer anchors, as described in U.S. Pat. Nos. 4,021,990 and 4,598,518 and wire formative wall ties providing a positive interlocking connection therebetween.

In the mode of practicing the invention, wherein the inner wythe is constructed from a masonry block material, the masonry anchor has, for example, a truss portion with eye wire extensions welded thereto. The eye wires extend into the cavity between the wythes. Each eye wires accommodates the threading thereonto of a wire wall tie through the open end of the wall tie. The wall tie is then positioned so that the open end is utilizable as part of the facing wall tie. The masonry anchor is embedded in a bed joint of the interior wythe. The facing wythe is anchored by mounting in bed joints of the exterior wythe the open end of the low-profile wire formative wall tie. The low-profile permits the mortar of the bed joint to flow over and about the insertion end of the wall tie and secure the tie to the outer wythe. Because the eye wires have sealed eyelets and the open ends of the wall ties are sealed in the joints of the exterior wythes, a positive interengagement results.

In the mode of practicing the invention, wherein the inner wythe is a dry wall construct, a dry wall anchor, which is a stamped metal unit, is attached by sheetmetal screws to the metal vertical channel members of the wall. Each wall anchor accommodates in an opening therethrough the threading of a low-profile wire formative wall tie. As in the case of the masonry inner wythe, the open end of the wall tie is then positioned so that the open end is utilizable as part of the insertion end of the facing wall tie. The facing wall tie has a compressibly reduced in height and is mounted along the exterior wythe to receive the open end of wire wall tie with each leg thereof being placed adjacent one side of reinforcement wire. The low-profile of the facing wall tie is embedded in a bed joint of the exterior wythe. Because the dry wall anchor opening is a closed loop and the open ends of the wall ties are sealed in the joints of the exterior wythes, a positive interengagement results.

OBJECTS AND FEATURES OF THE INVENTION

It is an object of the present invention to provide in a wall structure having a facing wythe and a inner wythe, a veneer anchor system which employs a low-profile wire formative in the mortar joint of the facing wythe and is positively interconnected with a wall anchor attached to the inner wythe.

It is another object of the present invention to provide labor-saving devices to aid in the installation of brick and stone veneer and the securement thereof to an inner wythe.

It is yet another object of the present invention to provide a low-profile anchor system which ties to the continuous wire reinforcement of the inner wythe in a manner such that the mortar layer thickness in the facing wythe is readily maintainable.

It is a further object of the present invention to provide a low-profile anchor system comprising a limited number of component parts that are economical of manufacture resulting in a relatively low unit cost.

It is yet another object of the present invention to provide a veneer anchor system which is easy to install and is highly resistant to being pulled out of the mortar layer.

It is a feature of the present invention that the portion of the wall tie embedded in the joint of the facing wythe has a pattern impressed thereon.

It is another feature of the present invention that the wall tie is dimensioned with a sufficiently low profile so that, when inserted into the mortar layer, the mortar thereof can flow around and into the low-profile wall tie.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
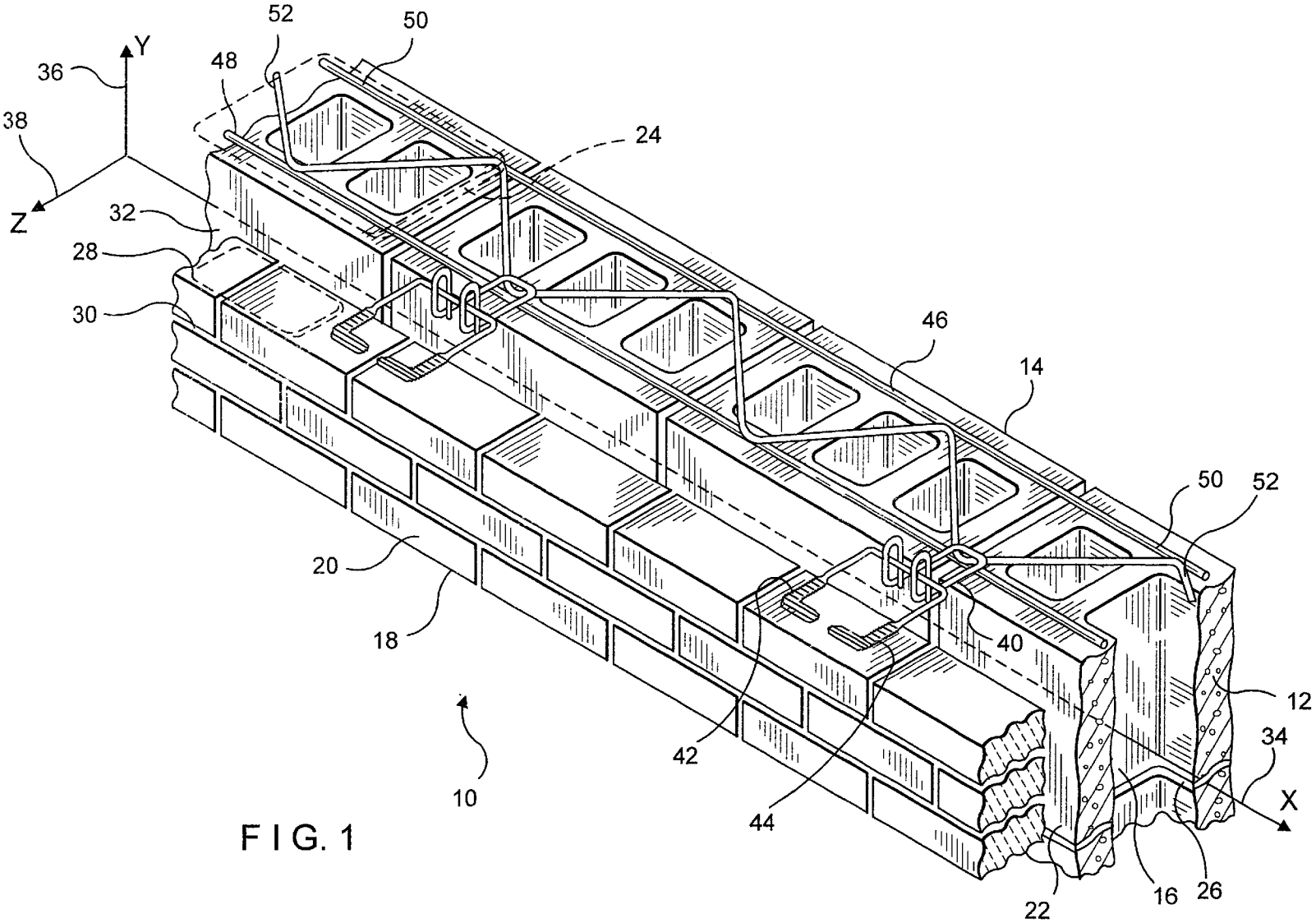
FIG. 1 is a perspective view of a first embodiment of a low-profile, wall tie of this invention and shows a wall with an interior wythe of masonry block and an exterior wythe of brick, with selected aligned bed joints and utilizing aforesaid wall tie.
Figures 2, 3:
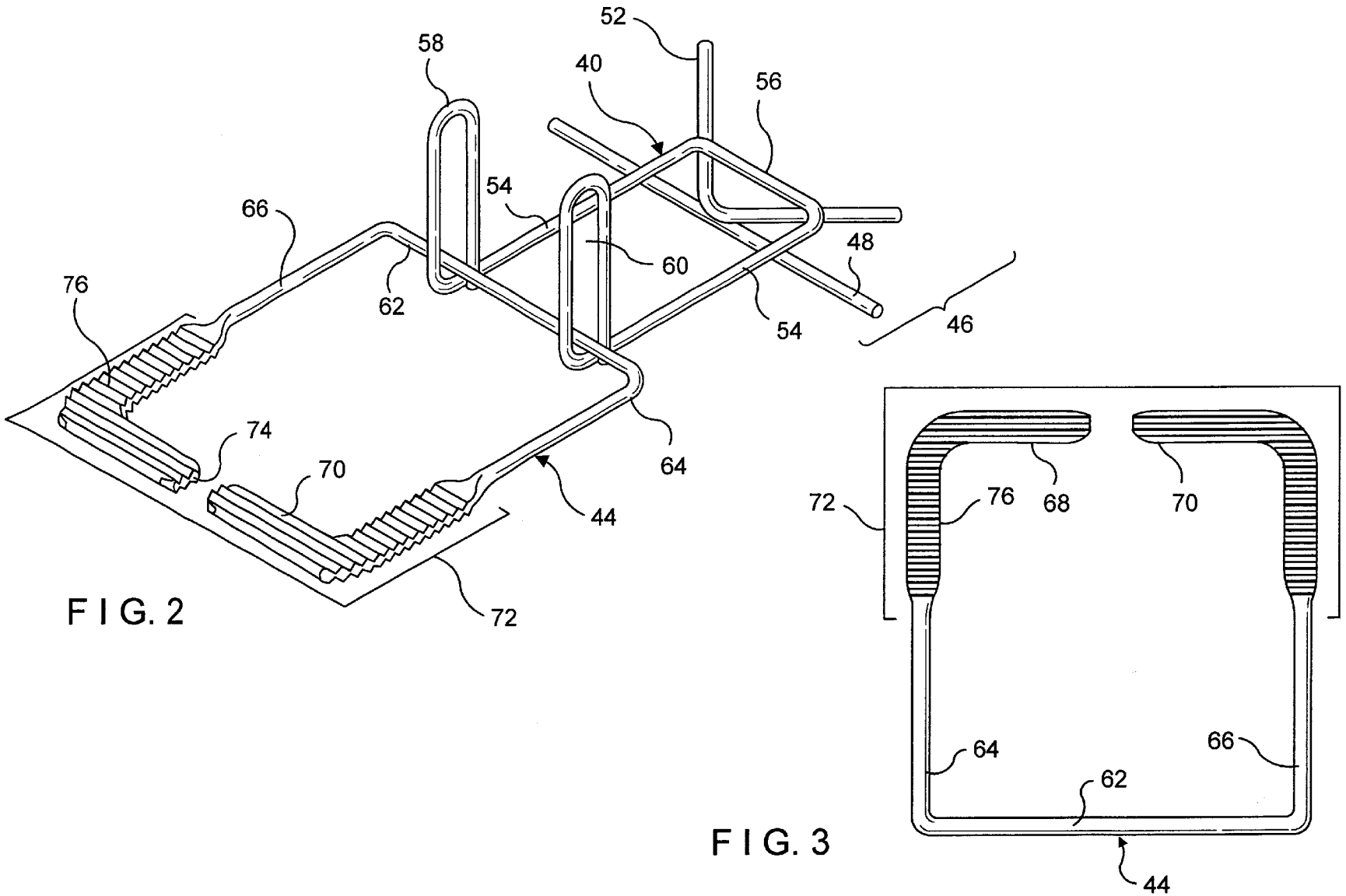
FIG. 2 is a partial perspective view of FIG. 1 showing the wall anchor and the low-profile, wall tie.
FIG. 3 is a partial perspective view of the wall tie of FIG. 2 showing the corrugated pattern thereof.

Referring now to FIGS. 1 to 3, the first embodiment of a low-profile wall tie device of this invention is shown and is referred to generally by the numeral 10. In this embodiment, a wall structure 12 is shown having an interior wythe 14 of masonry blocks 16 and an exterior wythe 18 of facing brick 20. Between the interior wythe 14 and the exterior wythe 18, a cavity 22 is formed. In the first embodiment, successive bed joints 24 and 26 are formed between courses of blocks 16 and the joints are substantially planar and horizontally disposed. Also, successive bed joints 28 and 30 are formed between courses of bricks 20 and the joints are substantially planar and horizontally disposed. For each structure, the bed joints 24, 26, 28 and 30 are specified as to the height or thickness of the mortar layer and such thickness specification is rigorously adhered to so as to provide the uniformity inherent in quality construction. Selected bed joint 24 and bed joint 28 are constructed to align, that is to be substantially coplanar, the one with the other. For purposes of discussion, the exterior surface 32 of the interior wythe 14 contains a horizontal line or x-axis 34 and an intersecting vertical line or y-axis 36. A horizontal line or z-axis 38 also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the y-axis. The system 10 includes a masonry anchor 40 constructed for embedment in bed joint 24 and a facing anchor 42 constructed for embedment in bed joint 28, including a low-profile, wire formative wall tie member 44.

The masonry anchor 40 is shown in FIG. 1 as being emplaced on a course of blocks 16 in preparation for embedment in the mortar of bed joint 24. In the best mode of practicing the invention, a truss or reinforcement wire portion 46 is constructed of a wire formative with two parallel continuous straight wire members 48 and 50 spaced so as, upon installation, to each be centered along the outer walls of the masonry blocks 16. An intermediate wire body or wire 52 is interposed therebetween and connects wire members 48 and 50 forming chord-like portions of the truss 46. At intervals along the truss 46, spaced pairs of transverse wire members 54 are attached thereto and are attached to each other by a rear leg 56 therebetween. These pairs of wire members 54 extend into the cavity 22. As will become clear by the description which follows, the spacing therebetween is constructed to limit the x-axis movement of the construct. Each transverse wire member 54 has at the end opposite the attachment end an eye wire portion 58 formed continuous therewith. A sheetmetal loop is an alternative construction in lieu of eye wires shown in the best mode; however, the wire formative has been found to be structurally superior. Upon installation, the eye 60 of eye wire portion 58 is constructed to be within a substantially vertical plane normal to exterior surface 32. The eye 60 is dimensioned to accept a wall tie threadedly therethrough and is thus slightly larger than the diameter of the tie. This relationship minimizes the y- and z-axis movement of the construct. For positive engagement, the eye 60 of eye wire portion 58 is sealed forming a closed loop.

The wall tie 44 is generally rectangular in shape and is dimensioned to be accommodated by a pair of eye wires 58 previously described. The wall tie 44 has a rear leg portion 62, two parallel side leg portions 64 and 66, and two front leg portions 68 and 70. The front leg portions 68 and 70 are spaced apart at least by the diameter of the wire member 54. An insertion portion 72 of wall tie 44, upon installation, extends beyond cavity 22 into bed joint 28, which portion includes front leg portions 68 and 70 and part of side leg portions 64 and 66 adjacent to front leg portions 68 and 70. The longitudinal axes of leg portions 62, 64, 66, 68 and 70 are substantially coplanar. The side leg portions 64 and 66 are structured to function cooperatively with the spacing of transverse wire members 54 to limit the x-axis movement of the construct.

The insertion portion 72 is considerably compressed and, while maintaining the same mass of material per linear unit as the adjacent wire formative, the vertical height 74 is reduced. The insertion end of the facing wall tie is a wire formative formed from a wire having a diameter substantially equal to the predetermined height of the mortar joint. Upon compressible reduction in height, the insertion end of the facing wall tie is mounted upon the exterior wythe positioned to receive mortar thereabout. The insertion end of the facing wall tie, usually the open end of wire wall tie, retains the mass and substantially the tensile strength as prior to deformation. The vertical height 74 of insertion portion 72 is reduced so that, upon installation, mortar of bed joint 28 flows around the insertion portion 72. Upon compression, a pattern or corrugation 76 is impressed on insertion portion 72 and, upon the mortar of bed joint 28 flowing around the insertion portion, the mortar flows into the corrugations 76. For enhanced holding, the corrugations 76 are, upon installation, substantially parallel to x-axis 34. In this embodiment, the pattern 76 is shown impressed on only one side thereof; however, it is within the contemplation of this disclosure that corrugations or other patterning could be impressed on other surfaces of the insertion portion 72. With wall tie 44 constructed as described, the wall tie is characterized by maintaining substantially all the tensile strength as prior to compression while acquiring a desired low profile.

Figure 4:
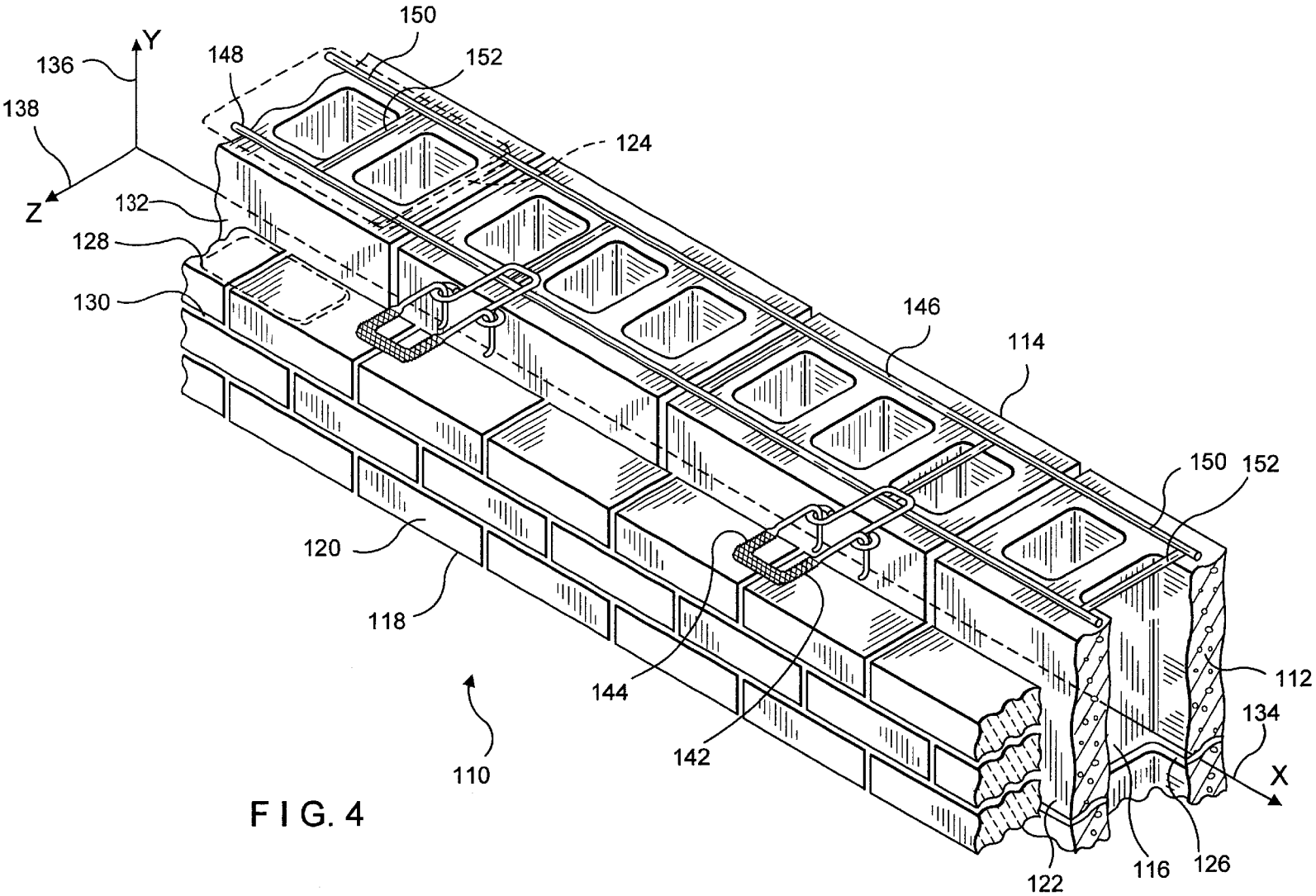
FIG. 4 is a perspective view of a second embodiment of a low-profile wall tie, similar to FIG. 1, but employing a ladder-type reinforcement in the interior wythe and a low-profile, rectangular pintle wall tie in the exterior wythe without aligned bed joints.
Figure 5:
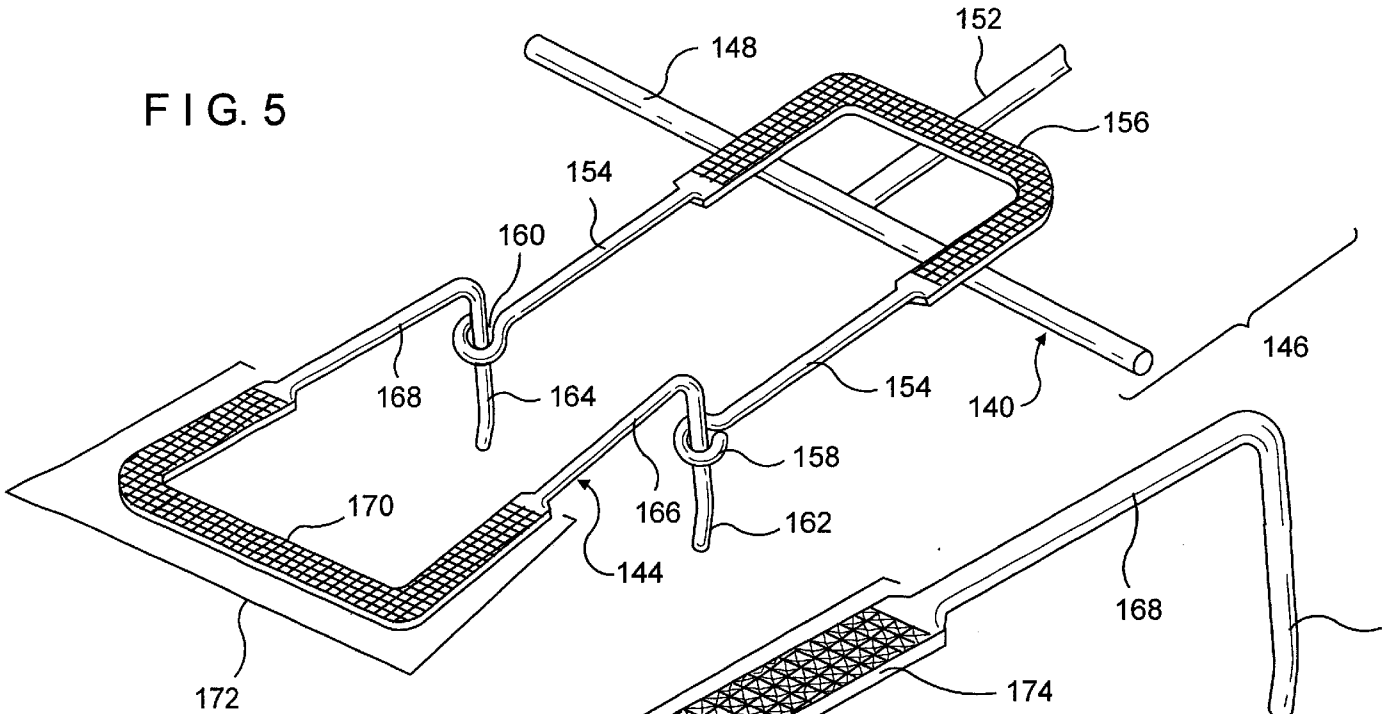
FIG. 5 is a partial perspective view of FIG. 4 showing a portion of the wall anchor and the low-profile wall tie.
Figure 6:
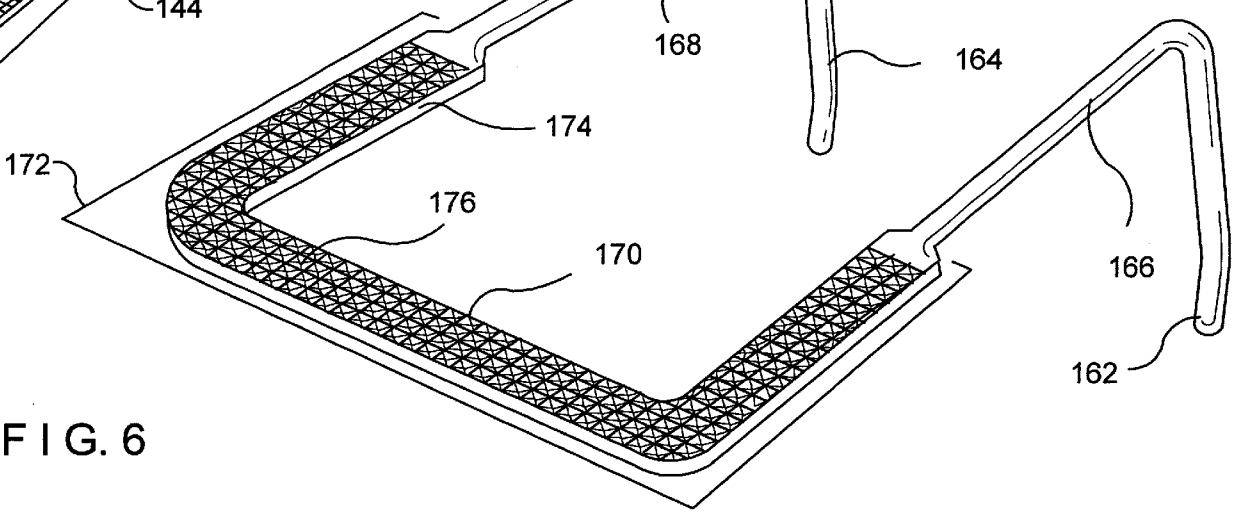
FIG. 6 is a partial perspective view of the wall tie of FIG. 5 showing the cellular pattern thereof.

The description which follows is of a second embodiment of the low-profile wall tie device. For ease of comprehension, where similar parts are used reference designators "100", units higher are employed. Thus, the wall tie 144 of the second embodiment is analogous to the wall tie 44 of the first embodiment. Referring now to FIGS. 4 to 6, the second embodiment of a masonry construction system of this invention is shown and is referred to generally by the numeral 110. As in the first embodiment, a wall structure 112 is shown having an interior wythe 114 of masonry blocks 116 and an exterior wythe 118 of facing brick 120. Between the interior wythe 114 and the exterior wythe 118, a cavity 122 is formed. Successive bed joints 124 and 126 are formed between courses of blocks 116 and the joints are substantially planar and horizontally disposed. Also, successive bed joints 128 and 130 are formed between courses of bricks 120 and the joints are substantially planar and horizontally disposed. Selected bed joint 124 and bed joint 128 are constructed to be interconnected utilizing the construct hereof; however, the joints 124 and 128 are unaligned. For purposes of discussion, the exterior surface 132 of the interior wythe 114 contains a horizontal line or x-axis 134 and an intersecting vertical line or y-axis 136. A horizontal line or z-axis 138 also passes through the coordinate origin formed by the intersecting x- and y-axes. The system 110 includes a masonry anchor 140 constructed for embedment in bed joint 124 and, a facing anchor 142 constructed for embedment in bed joint 128, including a low-profile wall tie member 144.

The masonry anchor 140 is shown in FIG. 4 as being emplaced on a course of blocks 116 in preparation for embedment in the mortar of bed joint 124. In this embodiment, a ladder type reinforcement wire portion 146 is constructed of a wire formative with two parallel continuous straight wire members 148 and 150 spaced so as, upon installation, to each be centered along the outer walls of the masonry blocks 116. An intermediate wire body or a plurality of wires 152 are interposed therebetween and connect wire members 148 and 150 forming rung-like portions of the ladder-type reinforcement 146. At intervals along the ladder-type reinforcement 146, spaced pairs of transverse wire members 154 are attached thereto and are attached to each other by a rear leg 156 therebetween. These pairs of wire members 154 extend into the cavity 122. The spacing therebetween limits the x-axis movement of the construct. Each transverse wire member 154 has at the end opposite the attachment end an eye wire portion 158 formed continuous therewith. Upon installation, the eyes 160 of eye wire portion 158 are constructed to be within a substantially horizontal plane normal to exterior surface 132. The eyes 160 are horizontally aligned to accept the pintles of a wall tie threaded therethrough from the unaligned bed joint. The eyes 160 are slightly larger than the diameter of the pintles, which dimensional relationships minimize the x- and z-axis movement of the construct. For ensuring engagement, the pintles of wall tie member 144 are available in a variety of lengths.

The low-profile wall tie or wire formative wall tie 144 is, when viewed from a top or bottom elevation, generally U-shaped and is, when viewed from right or left side elevation, is generally L-shaped. The low-profile wall tie 144 is dimensioned to be accommodated by a pair of eye wire portions 158 described, supra. The wall tie 144 has two rear leg portions or pintles 162 and 164, two parallel side leg portions 166 and 168, which are substantially at right angles and attached to the rear leg portions 162 and 164, respectively, and a front leg portion 170. An insertion portion 172 of wall tie 144, upon installation extends beyond the cavity 122 into bed joint 128, which portion includes front leg portion 170 and part of side leg portions 166 and 168. The longitudinal axes of side leg portions 166 and 168 and the longitudinal axis of the contiguous portions of the front leg portion 170 are substantially coplanar. An insertion portion 172 of wall tie 144, upon installation extends beyond the cavity 122 into bed joint 128, which portion includes front leg portion 170 and part of side leg portions 166 and 168.

The insertion portion 172 is considerably compressed and, while maintaining the same mass of material per linear unit as the adjacent wire formative, the vertical height 174 is reduced. The vertical height 174 of insertion portion 172 is reduced so that, upon installation, mortar of bed joint 128 flows around the insertion portion 172. Upon compression, a pattern or waffle-like, cellular structure 176 is impressed on insertion portion 172 and, upon the mortar of bed joint 128 flowing around the insertion portion, the mortar flows into the cells 176. For enhanced holding, the cells 176 are impressed on both sides of the insertion portion 172; however, it is within the contemplation of this disclosure that cells or other patterning could be impressed on only one surface of the insertion portion 172. With wall tie 144 constructed as described, the wall tie is characterized by maintaining substantially all the tensile strength as prior to compression while acquiring a desired low profile.

The description which follows is of a third embodiment of the masonry construction system. For ease of comprehension, where similar parts are used reference designators "200" units higher are employed. Thus, the wall tie 244 of the third embodiment is analogous to the wall tie 44 of the first embodiment.

Figure 7:
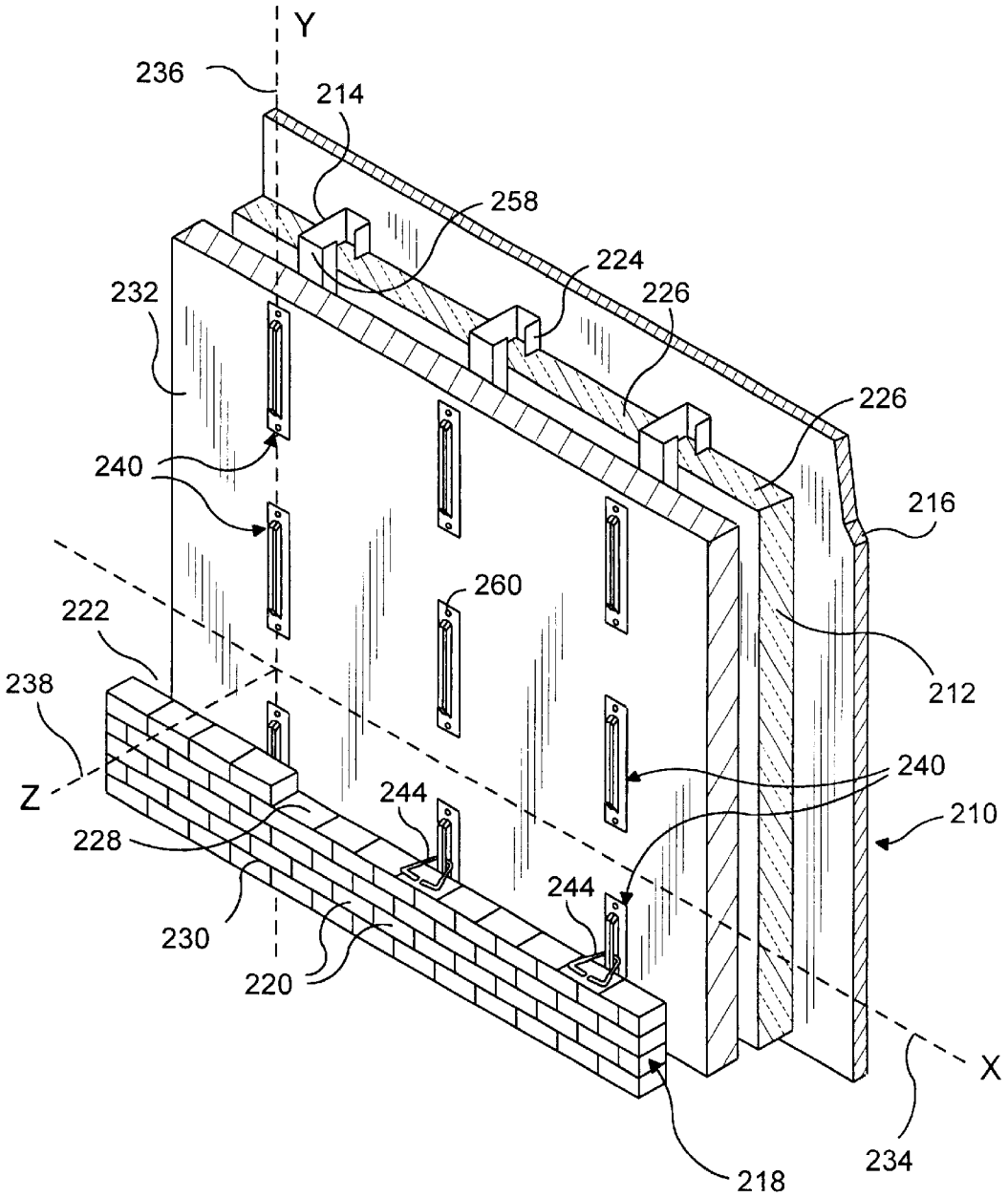
FIG. 7 is a perspective view of a third embodiment of a low-profile wall tie, similar to FIG. 1, but employing a dry wall anchor in the interior wythe and a low-profile, V-type wall tie.
Figure 9:
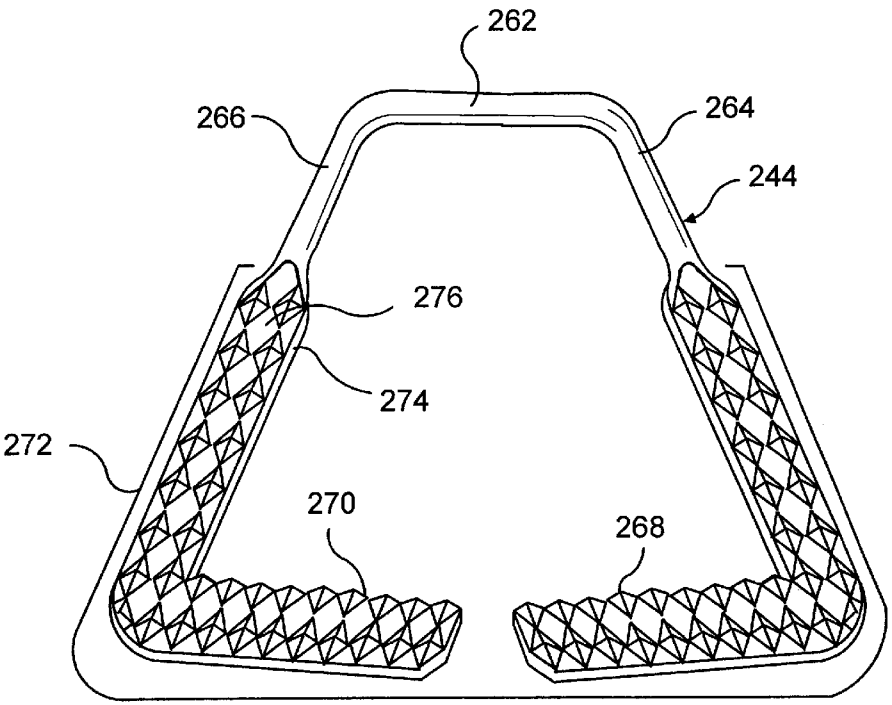
Figure 8:
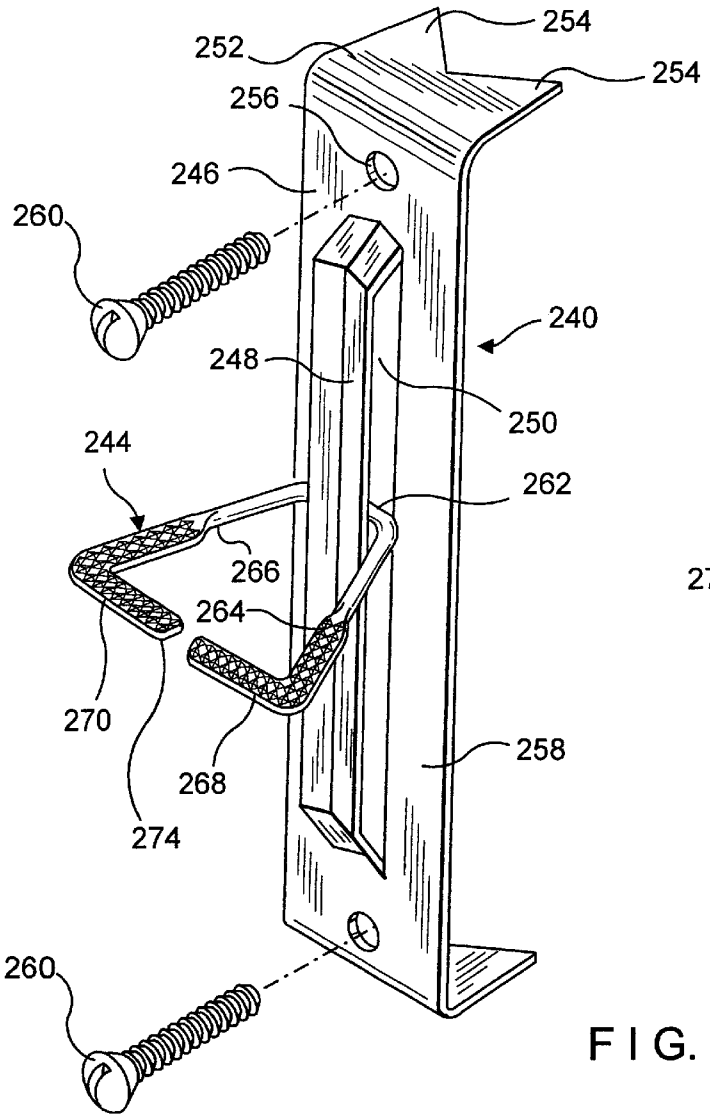
FIG. 8 is a partial perspective view of the wall tie of FIG. 7 showing the dry wall anchor and a low-profile, V-type wall tie; and, FIG. 9 is a partial perspective view of FIG. 8 showing the raised diamond non-slip pattern thereof.

Referring now to FIGS. 7 to 9, the third embodiment of the low-profile wall tie device is shown and is referred to generally by the numeral 210. The veneer anchoring system 210 employs the pronged veneer anchor construction first described in U.S. Pat. No. 4,598,518 and marketed by Hohmann and Barnard, Inc., Hauppauge, N.Y. 11788 under the trademark "DW-10-X". The dry wall structure 212 is shown having an interior wythe 214 with a wallboard 216 as the interior and exterior facings thereof. An exterior wythe 218 of facing brick 220 is attached to dry wall structure 212 and a cavity 222 is formed therebetween. The dry wall structure 212 is constructed to include, besides the wallboard facings 216, vertical channels 224 with insulation layer 226 disposed between adjacent channel members 224. The insulation layer 226 may optionally be mounted on the exterior surface of dry wall structure 212. Selected bed joints 228 and 230 are constructed to be in cooperative functional relationship with the wall anchor described in more detail below. For purposes of discussion, the exterior surface 232 of the interior wythe 214 contains a horizontal line or x-axis 234 and an intersecting vertical line or y-axis 236. A horizontal line or z-axis 238 also passes through the coordinate origin formed by the intersecting x- and y-axes. The system 210 includes a dry wall anchor 240 constructed for attachment to vertical channel members 224 and, a wall tie member 244.

Reference is now directed to the construction of the wall anchor or pronged veneer anchor 240 comprising a backing plate member 246 and a projecting bar portion 248. The projecting bar portion 248 is punched-out from the central portion of the stock plate member 246 so as to result in a centrally disposed aperture and, when viewed from the side elevation, a wall-tie-receiving slot 250. The aperture is substantially rectangular configuration and is formed in the plate member 246. The projecting bar portion 248 is thus disposed in substantially parallel relationship with respect to the plate member 246; however, the upper and lower ends of the projecting bar portion 248 are slightly angled to permit the full projection of the bar portion 248 with respect to the plate member 246. Secured to the upper and lower ends of the plate member 246 in a substantially perpendicular relationship are pronged end members 252 which are bifurcated to form prong portions or prongs 254. It is within the present invention to have the end members 252 formed with a single prong; however, for structural purposes of the bifurcated construction is preferred. The plate member 246 is also provided with bores 256 at the upper and lower ends thereof, the purpose and function of which will be discussed in more detail hereinbelow. As is best seen in FIG. 8, the projecting bar portion 248 is sufficiently spaced from the plate member 246 so as to form a slot 250 therebetween which is adapted to receive the wall tie 244 therewithin. In the fabrication of the dry wall as the inner wythe of this construction system 210, the channel members 224 are initially secured in place. In this regard, the channel members 224 may also comprise the standard framing members of a building. Sheets of exterior wallboard 216, which may be of an exterior grade gypsum board, are positioned in abutting relationship with the forward flange 258 of the channel member 224. While the insulating layer has herein been described as comprising a gypsum board, it is to be noted that any similarly suited rigid or flexible insulating material may be used herein with substantially equal efficacy. After the initial placement of the flexible insulation layer 226 and the wallboard 216, the veneer anchors 240 are secured to the surface of the wallboard 216 in front of channel members 224 by forcing the prongs 254 therein until the prongs 254 abuttingly engage the front flange 258 of the channel members 224. Thereafter, sheetmetal screws 260 are inserted into the bores 256 to fasten the anchor 240 to the flange 258 and to channel member 224.

The wall tie 244 is substantially a truncated triangularly shaped member and is dimensioned to be accommodated within slot 250 previously described. The wall tie 244 has a rear leg portion 262, two divergent side leg portions 264 and 266, and two parallel front leg portions 268 and 270. To facilitate installation, the front leg portions 268 and 270 are spaced apart at least by the thickness of the projecting bar portion 248. The longitudinal axes of leg portions 262, 264, 266, 268 and 270 are substantially coplanar. The side leg portions 264 and 266 are structured to function cooperatively with the width of the projecting bar portion 248 to limit the x- and z-axis movement of the construct. An insertion portion 272 of wall tie 244, upon installation, extends beyond the cavity 222 into bed joint 228, which portion includes the front leg portions 268 and 270 and part of side leg portions 264 and 266.

The insertion portion 272 is considerably compressed and, while maintaining the same mass of material per linear unit as the adjacent wire formative, the vertical height 274 is reduced. The vertical height 274 of insertion portion 272 is reduced so that, upon installation, mortar of bed joint 228 flows around the insertion portion 272. Upon compression, a raised diamond, non-slip pattern 276 is impressed on insertion portion 272 and, upon the mortar of bed joint 228 flowing around the insertion portion, the mortar flows into the interstices diamond pattern 176 between the raised diamonds of the pattern 276. For enhanced holding, the raised diamond pattern is shown on both sides thereof; however, it is within the contemplation of this disclosure that other patterning could be fashioned into the surfaces of the insertion portion 272. With wall tie 244 constructed as described, the wall tie is characterized by maintaining substantially all the tensile strength as prior to compression while acquiring a desired low profile.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A wall tie for a veneer anchoring system for use in the construction of a wall having an inner wythe and an outer wythe said outer wythe formed from a plurality of successive courses with a mortar joint opening of predetermined height between each two adjacent courses, said mortar joint upon construction being filled with mortar, said inner wythe and said outer wythe in spaced apart relationship the one with the other and forming a cavity therebetween, said veneer anchoring system having a wall anchor adapted for attachment to said inner wythe, said wall tie comprising:

a wire formative tie having an insertion end adapted to be embedded within said mortar joint and having an attachment end adapted to be interlockingly attached to said wall anchor;

said insertion end of said wire formative tie being compressibly reduced in height to a height substantially less than said predetermined height of said mortar joint, and upon insertion of said wire formative tie in said mortar joint, the remaining height thereof is adapted to be filled by said insertion end with said mortar thereabout.

2. A wall tie as described in claim 1 wherein said wire said wire formative is formed from a wire having a given mass and a diameter substantially equal to said predetermined height of said mortar joint, said wire, upon being compressibly deformed, retaining the mass of material per linear unit as the adjacent wire formative.

3. A wall tie as described in claim 1, wherein said insertion end of said wall tie has an upper surface and a lower surface, said upper surface upon being compressibly deformed has a pattern of recessed areas impressed thereon for receiving mortar therewithin enabling said wall tie to securely hold to the mortar joint.

4. A wall tie as described in claim 1, wherein said insertion end of said wall tie has an upper surface and a lower surface said lower surface upon being compressibly deformed has a pattern of recessed areas impressed thereon for receiving mortar therewithin.

5. A wall tie as described in claim 1, wherein said insertion end of said wall tie has an upper surface and a lower surface, each said lower and said upper surfaces upon being compressibly deformed has a pattern of recessed areas impressed thereon for accepting mortar therewithin enabling said wall tie to securely hold to the mortar joint.

6. A wall tie as described in claim 3, wherein said pattern is a corrugation with ridges and valleys.

7. A wall tie as described in claim 6, wherein said ridges of said corrugation are adapted, upon installation in said outer wythe, to be substantially parallel to the face plane thereof and further adapted by receiving mortar therewithin to increase the tie strength thereof.

8. A wall tie as described in claim 3, wherein said pattern is a cellular pattern with open cells therein.

9. A wall tie as described in claim 8, wherein said open cells of said cellular pattern are adapted, upon installation in said outer wythe and receiving mortar therewithin to increase the tie strength of said wall tie.

10. A wall tie as described in claim 3, wherein said pattern has a plurality of raised portions with interstitial areas therebetween.

11. A wall tie as described in claim 10, wherein said interstitial areas are adapted upon installation in said outer wythe and receiving mortar within the interstitial areas and increasing the tie strength of said wall tie.

12. A wall tie as described in claim 4, wherein said pattern is a corrugation with ridges and valleys.

13. A wall tie as described in claim 12, wherein said ridges of said corrugation are adapted, upon installation in said outer wythe, to be substantially parallel to the face plane thereof and further adapted by receiving mortar therewithin to increase the tie strength thereof.

14. A wall tie as described in claim 4, wherein said pattern is a cellular pattern with open cells therein.

15. A wall tie as described in claim 14, wherein said open cells of said cellular pattern are adapted, upon installation in said outer wythe and receiving mortar therewithin to increase the tie strength of said wall tie.

16. A wall tie as described in claim 4, wherein said pattern has a plurality of raised portions with interstitial areas therebetween.

17. A wall tie as described in claim 16, wherein said interstitial areas are adapted upon installation in said outer wythe and receiving mortar within the interstitial areas, to increase the tie strength of said wall tie.

18. A wall tie as described in claim 5, wherein said pattern is a corrugation with ridges and valleys.

19. A wall tie for a veneer anchoring system for use in the construction of a wall having an inner wythe and an outer wythe said outer wythe formed from a plurality of successive courses of bricks with a mortar joint between of predetermined height each two adjacent courses, said inner wythe and said outer wythe in spaced apart relationship the one with the other and forming a cavity therebetween, said veneer anchoring system having a wall anchor adapted for attachment to said inner wythe forming a wall resistant to lateral forces, said wall tie comprising:

a wire formative tie having an insertion end adapted to be inserted in said mortar joint and an attachment end adapted to be interlockingly attached to said wall anchor, said insertion end being compressibly deformed to reduce the height thereof to a height below said predetermined height of said brick mortar joint and adapted to, upon installation, permit mortar to flow therearound.

20. A wall tie as described in claim 19 wherein said wall tie is adapted for use with a cementitious slurry in said mortar joint and, upon installation of said wall tie into said cementitious slurry of said brick mortar joint, the slurry flows about the said insertion end securing the wall tie to said outer wythe.

21. A wall tie as described in claim 20 wherein said insertion end of said wire formative tie is formed from a wire being compressibly deformed, retaining the mass and substantially the tensile strength as prior to deformation.

22. A wall tie for a veneer anchoring system for use in the construction of a wall having an inner wythe and an outer wythe said outer wythe formed from a plurality of successive courses with a mortar joint opening of predetermined height between each two adjacent courses, said mortar joint upon construction being filled with mortar, said inner wythe and said outer wythe in spaced apart relationship the one with the other and forming a cavity therebetween, said veneer anchoring system having a wall anchor adapted for attachment to said inner wythe, said wall tie comprising:

a wire formative tie having an insertion end adapted to be embedded within said mortar joint and having an attachment end adapted to be interlockingly attached to said wall anchor;

said insertion end of said wire formative tie being compressibly reduced in height to a height substantially less than said predetermined height of said mortar joint, and upon insertion of said wire formative tie in said mortar joint, the remaining height thereof is adapted to be filled by said insertion end with said mortar thereabout and being formed from a wire having a given mass and substantially the tensile strength as prior to deformation.

* * * * *